United States Patent [19]

Minor

[11] Patent Number: 4,684,243

[45] Date of Patent: Aug. 4, 1987

[54] OPTIONAL OUTPUT FOR TEST PATCHES

[75] Inventor: James C. Minor, Rochester, N.Y.

[73] Assignee: Eastman Kodak Company, Rochester, N.Y.

[21] Appl. No.: 863,652

[22] Filed: May 15, 1986

[51] Int. Cl.[4] ..... G03G 15/00

[52] U.S. Cl. ..... 355/14 SH; 355/3 SH; 355/14 E; 355/14 CH; 355/14 D

[58] Field of Search ..... 355/14 SH, 3 SH, 14 R, 355/14 E, 14 D, 14 CH, 3 R

[56] References Cited

U.S. PATENT DOCUMENTS

| | | | |
|---|---|---|---|
| 4,082,445 | 4/1978 | Steiner | 355/14 D |
| 4,215,930 | 8/1980 | Miyakawa | 355/14 D |
| 4,239,372 | 12/1980 | Iwai | 355/14 D |
| 4,272,182 | 6/1981 | Abe et al. | 355/14 D |
| 4,304,486 | 12/1981 | Cormier | 355/14 SH |
| 4,313,671 | 2/1982 | Kuru | 355/14 D |
| 4,348,099 | 9/1982 | Fantozzi | 355/14 D |
| 4,348,100 | 9/1982 | Snelling | 355/14 R |
| 4,372,672 | 2/1983 | Pries | 355/14 D |
| 4,519,695 | 5/1985 | Murai et al. | 355/14 D |
| 4,522,481 | 6/1985 | Imai et al. | 355/14 D |
| 4,533,234 | 8/1985 | Watai et al. | 355/14 D |
| 4,551,005 | 11/1985 | Koichi | 355/14 D |
| 4,572,654 | 2/1986 | Murai et al. | 355/14 D |

FOREIGN PATENT DOCUMENTS 1559341 1/1980 United Kingdom .

*Primary Examiner*—R. L. Moses

*Attorney, Agent, or Firm*—Milton S. Sales

[57] ABSTRACT

An electrographic copy machine of the type having an image transfer member, means for producing document images in an image area of the image transfer member, and means for producing test patch images on the image transfer member is disclosed. The machine includes apparatus for selectively controlling whether or not the test patch images are transferred from the image transfer member to the copy sheets by selectively aligning or not aligning the copy sheets and the test patches on the image transfer member and effecting the transfer of images from the image transfer member to a copy sheet aligned with the images to be transferred, whereby the copy sheets receive or do not receive images of the test patches in accordance with the relative positions of the copy sheets and the test patches on the image transfer member.

10 Claims, 9 Drawing Figures

OPTIONAL OUTPUT FOR TEST PATCHES

FIELD OF THE INVENTION

This invention relates to test patches useful in controlling image density parameters in electrographic machines, and more specifically to apparatus for selectably reproducing the test patches on copy sheets produced by the machines.

DESCRIPTION OF THE PRIOR ART

In electrographic machines such as printers and copiers, control of image density is required to produce copied images having constant and predeterminable image densities. Parameters which determine image density include charger energization, exposure energy, development voltage bias, toner concentration in the developer mixture, and image transfer potential.

These are image density parameter control methods known in the prior art wherein at least two test patches of different latent image potentials are formed on respective portions of a non-image area of an image transfer member. The patches are developed, and the resulting toner densities of the patches are measured by a sensor. The sensor output is coupled to a circuit used to control the image density parameters.

Because such test patches are intended principally for use with automatic adjusting means, they are generally positioned out of the image area of the image transfer member. However, some operators may find it desirable to see reproductions of the patches on each output copy. Other operators may find it sufficient to see the reproductions only occasionally (i.e., for example, every 50th copy), and still other operators may never want to see the patches. Therefore, it would be highly desirable to provide means to selectively either reproduce or not reproduce the test patches on copies in accordance with the operator's wishes.

SUMMARY OF THE INVENTION

The present invention is useful in electrographic copy machines having means for producing document images in an image area of a image transfer member and means for producing test patches on the image transfer member. In accordance with the invention, apparatus is provided for selectively controlling whether or not the test patch images are transferred from the image transfer member to the copy sheets by selectively aligning or not aligning the copy sheets and the test patches on the image transfer member, whereby the copy sheets receive or do not receive images of the test patches in accordance with the relative positions of the copy sheets and the test patches.

Several embodiments of the present invention are disclosed herein. In one embodiment, the test patches are exposed on the image transfer member laterally (cross-track) of the image areas, and the electrographic copy machine includes means for selectively shifting copy sheets laterally of the image transfer member to overlie or not overlie the test patches. In another embodiment, the test patches are exposed on the interframe region between image areas. When copy sheets are to receive an image of the test patches, the exposure of the test patches is delayed (or advanced) relative to the normal operating cycle of the machine to shift the image into the image area. In yet another embodiment wherein the test patches are exposed in the interframe region, the copy sheet feeding operation is delayed (or advanced) to align the copy sheet with the test patches.

Whatever the mode for affecting selected alignment of copy sheets with the test patches, it may be desirable to provide a special output tray for copies having images of the test patches. Such provision has been disclosed as a preferred feature of the present invention.

The invention, and its objects and advantages, will become more apparent in the detailed description of the preferred embodiment presented below.

BRIEF DESCRIPTION OF THE DRAWING

In the detailed description of the preferred embodiment of the invention presented below, reference is made to the accompanying drawings in which.

DETAILED DESCRIPTION OF THE PREFERRED EMBODIMENT

The Machine Generally

Figure 1:
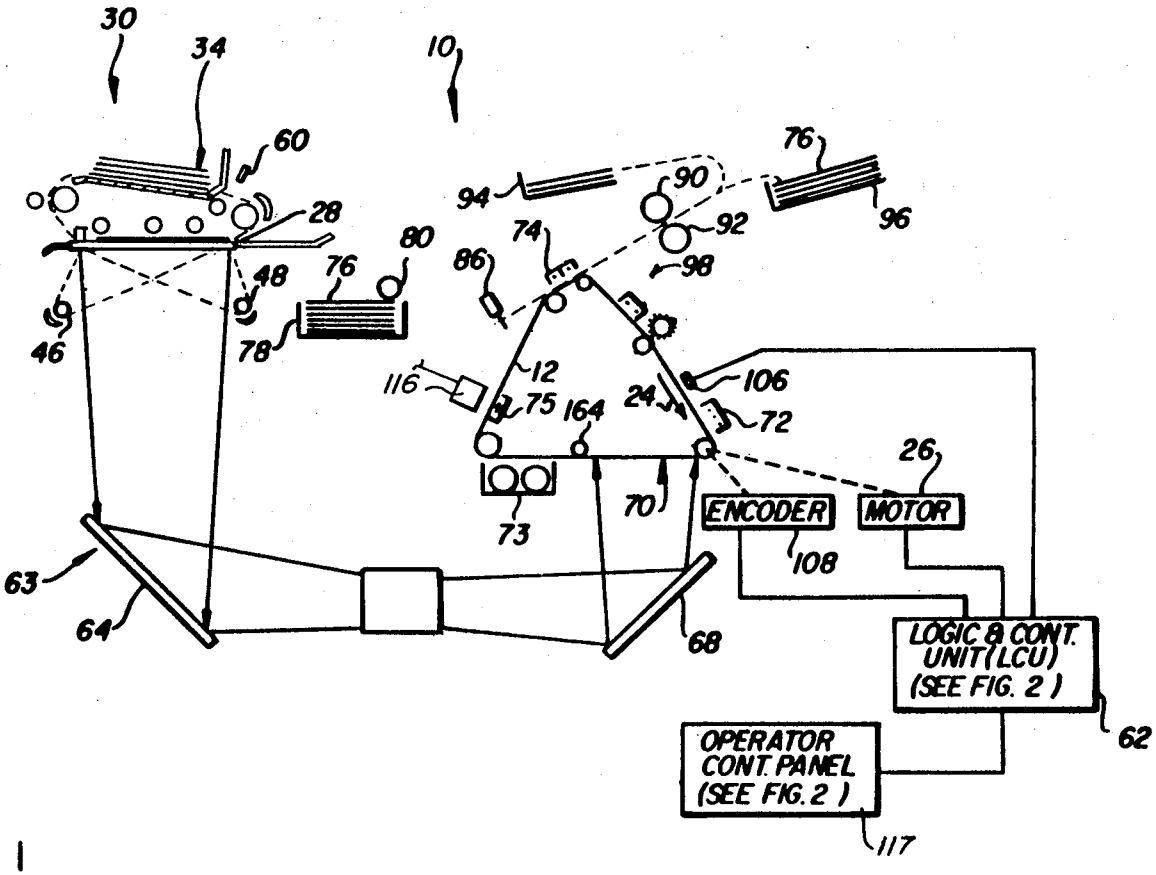
FIG. 1 is a vertical schematic representation of an electrographic machine according to the present invention.

With reference of FIG. 1, there is shown an electrographic machine 10 having an image transfer member in the form of a photoconductive belt 12 trained about rollers. Belt 12 is moved in a clockwise direction, as represented by arrow 24. Machine 10 includes an exposure platen 28 against which an original document can be positioned in an exposure position for copying. Originals are fed to platen 28 by a recirculating document feeder 30 or by a document positioner 31. Feeder 30 circulates originals in sequence from the bottom of a set 34 of originals to exposure platen 28 and then back up to the top of the set. A more detailed disclosure of the operation and structure of feeder 30 is disclosed in commonly-assigned U.S. Pat. No. 4,099,860. As an original moves along the path toward platen 28, a detector 60 generates a count signal which is applied to a logic and control unit (LCU) 62. It will be understood that original documents need not be hard copy originals, but may also be electronic data.

An image-producing means 63 includes a pair of flash lamps 46 and 48 for illuminating an original document; where upon an image is produced which is projected by a mirror 64, a lens 66, and a mirror 68 onto belt 12 at an exposure station 70. The magnification of lens 66 is such that light is projected over an area on belt 12 defined as an image area, or as a frame, which could be, for example, 8½ inches wide.

The speed of belt 12 and the timing of flash lamps 46, 48, are controlled to locate an image on belt 12 and to provide a suitable interframe distance between image areas. In advance of exposure station 70 is a charging station 72 for applying an electrostatic charge to belt 12. At exposure station 70, the projected light image dissipates the electrostatic charge at the exposed areas of the photoconductive belt to form a latent electrostatic image on belt 12 corresponding to the image on the original.

The latent electrostatic image on belt 12 is developed with toner at a conventional developer station 73. The toner image is then subjected to radiation by a post-development erase lamp 75 to reduce the electrical stress on photoconductive belt 12 and to reduce the attraction between the toner image and belt 12.

As the toner image on belt 12 approaches a transfer station 74, a copy sheet 76 is fed from a supply 78 by a feed roller 80. The copy sheet 76 is biased against a registration mechanism 86, which is moved out of the path of the copy sheet at the appropriate point in the cycle of machine 10 to obtain the desired positioning of sheet 76 relative to an image on belt 12.

A transfer station 74 serves as a means to effect the transfer of the toner image to copy sheet 76 by (1) applying a charge opposite in polarity to that of the toner image and (2) neutralizing the charge on copy sheet so that it easily separates from belt 12. The copy sheet bearing toner is then passed through a pair of heated fuser rollers 90 and 92. After fusing, the copy sheet is transported to an upper output tray 94 or to a side output tray 96. Mechanical and electrical cleaning of photoconductive belt 12 is effected at a cleaning station 98.

Timing of the movement of belt 12 in relation to the operation of the various elements of machine 10, including feeder 30, is controlled by means of a plurality of perforations (not shown) along one of the edges of belt 12. As an example, belt 12 can be divided into six image areas by a first set of perforations and each image area may be subdivided into 51 sections by a second set of perforations. The relationship of the two sets of perforations to the image area on belt 12 is disclosed in detail in commonly-assigned U.S. Pat. No. 3,914,047. At a fixed location along the path of movement of belt 12, there is provided a detector 106 for detecting belt perforations and for providing timing pulses to LCU 62. An encoder 108 is linked to roller 22 and provides a series of timing pulses to LCU 62 which are used in conjunction with the pulses from detector 106 to control the operation of machine 10.

TEST PATCHES IN INTERFRAME

Figure 2:
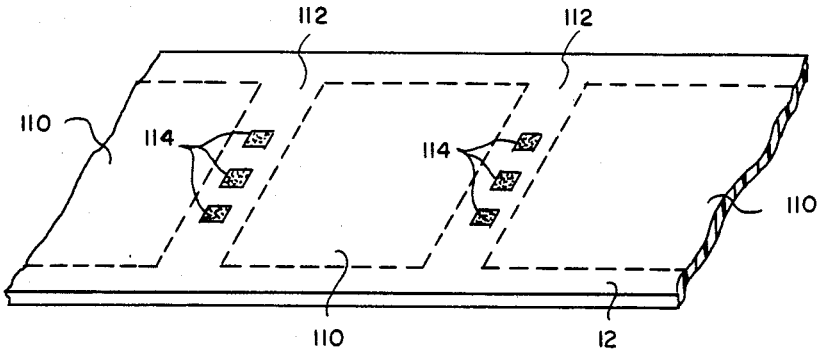
FIG. 2 is an enlarged fragmentary perspective view of a portion of the electrographic machine of FIG. 1 including a portion of the image transfer member.

Referring to FIG. 2, photoconductive belt 12 is illustrated with a plurality of image areas or film frames 110 spaced slightly apart from each other along the longitudinal length of the belt; thus defining non-image interframe regions 112.

In order to control the electrographic process, it is known to provide one or more test patches 114 of toner in interframe regions 112. The test patches can be formed by leaving such areas charged when the other parts of the photoconductive belt outside image areas 110 are discharged, and then exposing the area to a predetermined level of irradiation. Then toner is applied to the test patches by development station 73. In this manner the density of toner on the test patches is directly related to the density of toner in image areas 110. By way of example, three toned test patches 114 are shown adjacent to each other in each interframe region 112. However, more or fewer control areas could be provided if desired. When multiple test patches for each interframe region are used for density measurement, the patches preferably are exposed to obtain different density levels of toner so that the electrographic process can be checked and controlled for various operating parameters.

As test patches 114 pass erase lamp 75, light rays from the lamp travel from the back side of the photoconductive belt and through the test patches and toner on the front surface of the belt. A photodetector in the form of a small area photodiode 116 is provided closely adjacent the surface of the belt for receiving light rays passing through the test patches as they are driven between the lamp 32 and the photodetector.

A signal generated by photodetector 116 is provided to LCU 62, which is programmed to provide various feedback signals to portions of the apparatus in response to the signal received from the photodetector. For example, the control signal from the photodetector can cause the LCU to regulate a number of process parameters such as the voltage applied to photoconductive belt 12 at charging station 72 and the intensity level of lamps 46 and 48 of the exposure station to thereby control the exposure of the belt. In general, the signal from photodetector 116 can be used to control any process parameter that effects the density of the toner images on the photoconductor.

LOGIC AND CONTROL

Figure 3:
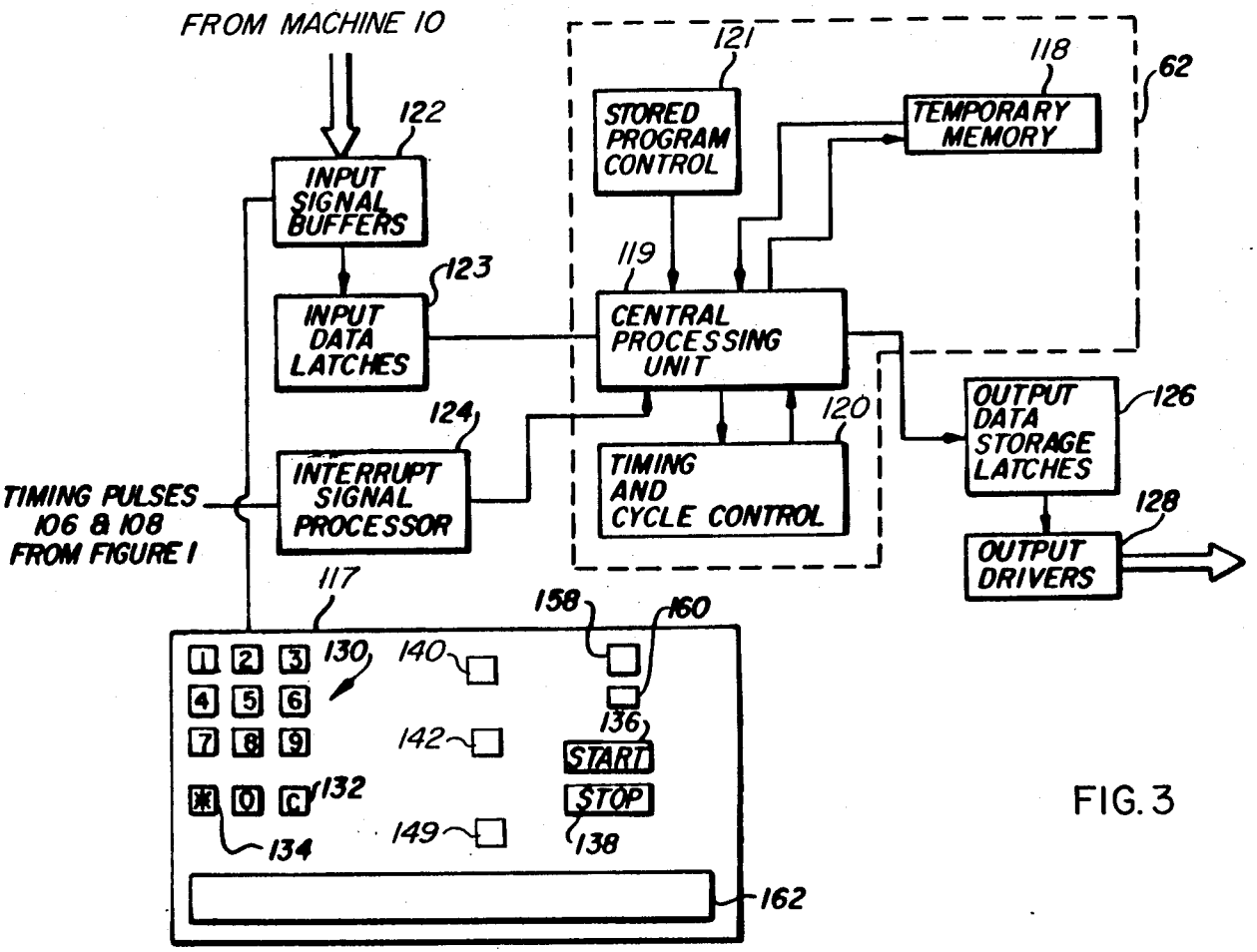
FIG. 3 is a block diagram of the logic and control unit of the apparatus of FIG. 1 and a schematic representation of the operator control panel of the apparatus of FIG. 1.

LCU 62 and an operator control panel 118 are shown in greater detail in FIG. 3. LCU 62 has a programmable computer, such as a microprocessor, which has a stored program responsive to input signals for sequentially actuating the various elements of machine 10 as well as for controlling the operation of many other functions of machine 10 (as disclosed in greater detail in the aforementioned U.S. Pat. No. 3,914,047). Programming of commercially available microprocessors, such as Intel Model 8085 (which along with others can be used in accordance with the invention), is a conventional skill well understood in the art. The following disclosure is written to enable a programmer having ordinary skill in the art to produce an appropriate control program for the microprocessor. The particular details of any such program would, of course, depend on the architecture of the designated microprocessor.

As shown in FIG. 3, LCU 62 includes temporary memory 118 which can be provided by Read/Write Memory or Random Access Memory, a central processing unit 119, a timing and cycle control unit 120, and a stored program control unit 121 which comprises a Read-Only Memory. Data input and output are performed sequentially under program control. Input data is applied to LCU 62 either through input signal buffers 122 to input data latches 123 or through an interrupt signal processor 124. The input signals are derived from operator control panel 117, for tiny pulses such as those from detector 106 and encoder 108, and from various analog to digital converters which process signals from monitoring devices (not shown) in machine 10. The output data and control signals are applied to output data storage latches 126 which provide inputs to suitable output drivers 128 which are connected to various elements of machine 10.

Operator control panel 117 includes a plurality of operator actuatable switches (buttons). For example, a numerical keyboard 130 includes ten buttons for "0"–"9" inclusive A "c" button 132 is used to cancel or clear the previous instructions fed in from panel 117. A star "*" button 134 is actuated by the operator to designate when copy sheets are to contain images of test patches. This function will be described in greater detail later. A "start" button 136 initiates operation of apparatus 10 and a stop button 138 terminates operation of machine 10.

Machine 10 can be operated in either a noncollate mode or a collate mode. In the noncollate mode, the output of machine 10 is sets of uncollated copies which may be collated manually or by a sorter (not shown). In the collate mode, sets of collated copies are produced. If the noncollate mode is desired, a button 140 is depressed; and if the collate mode is desired, a button 142 is depressed. In the noncollate mode, each original in the set of originals 34 in feeder 30 is fed individually to platen 28 where machine 10 makes the number of copies requested by the operator before making copies of the next original. On the other hand, in the collate mode, each original in a set of originals 34 is sequentially copied, and the set of originals 34 is recyled until the number of copies requested is completed. Button 158 is actuated to effect output of copies to side output tray 96, while button 160 is actuated to effect output of copies to upper output tray 94. A display 162 shows messages indicating to the operator various conditions which occur in machine 10, for example, the mode the machine is operating in, what action should be taken next, where jams may be located, etc.

OPERATION

Figure 4:
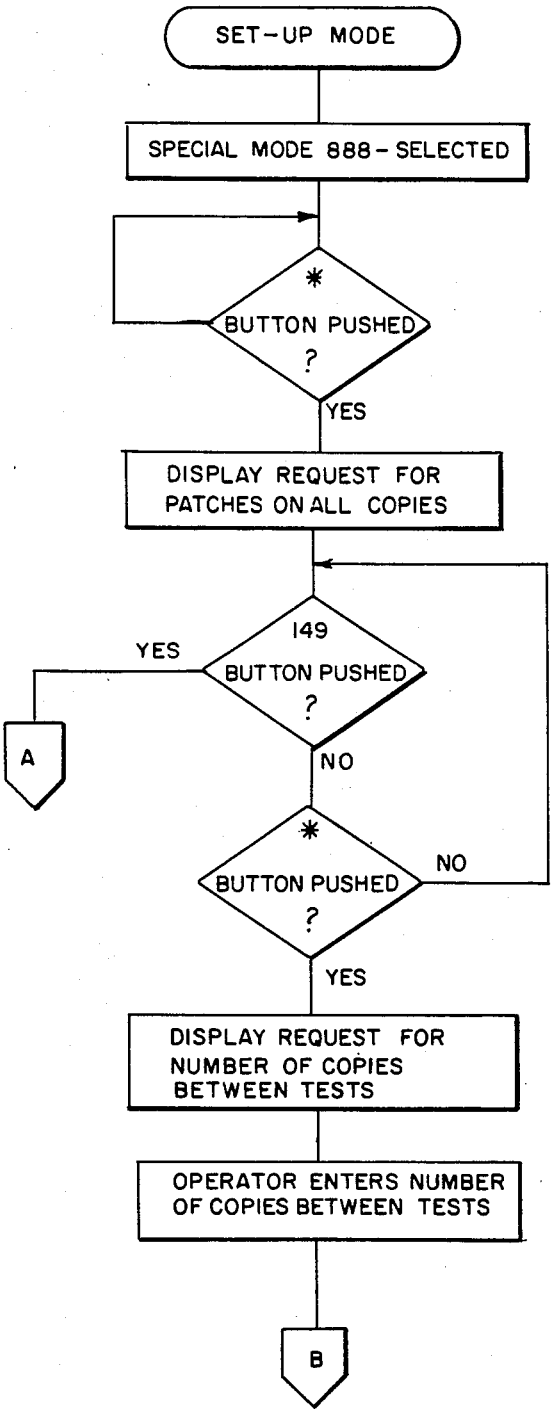
FIGS. 4–6 combine to form a flow chart of the set-up and producing modes of operation of the machine shown in FIG. 1.
Figure 5:
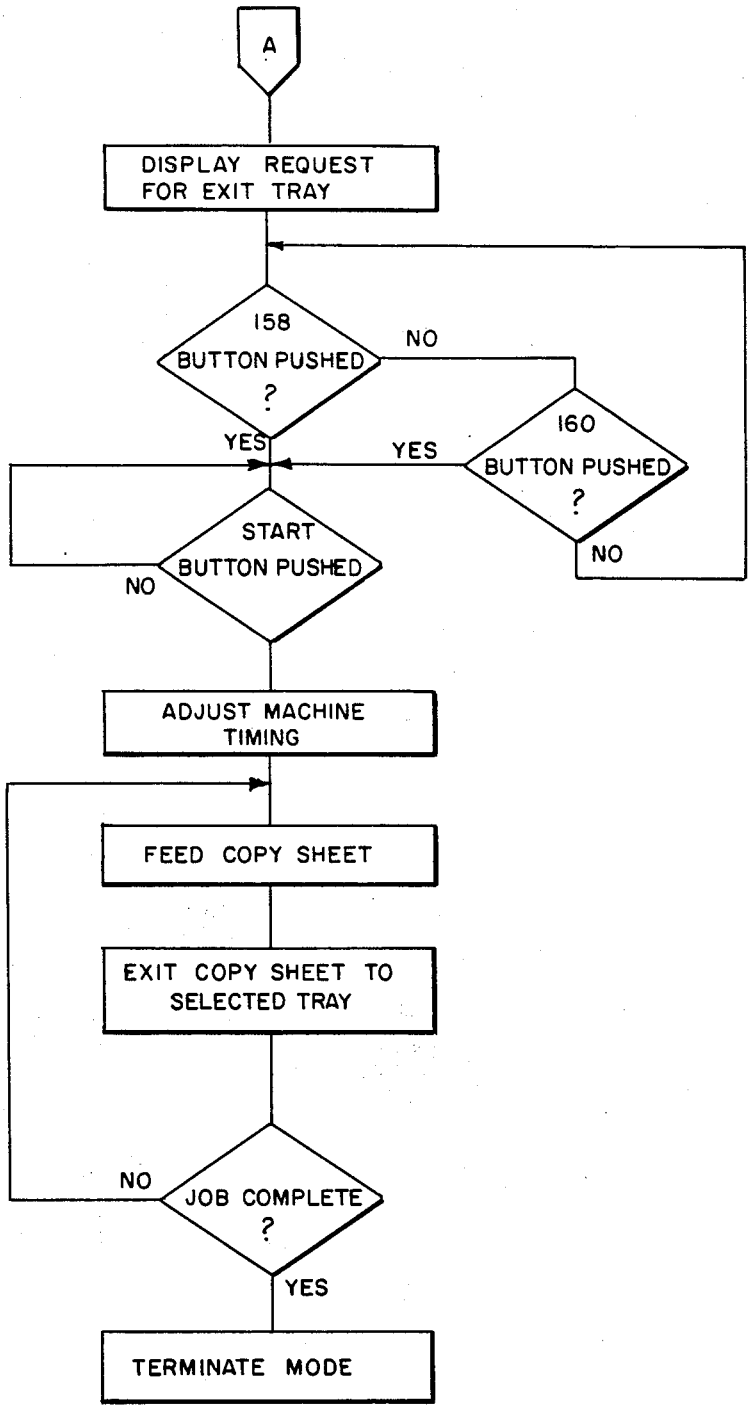
Figure 6:
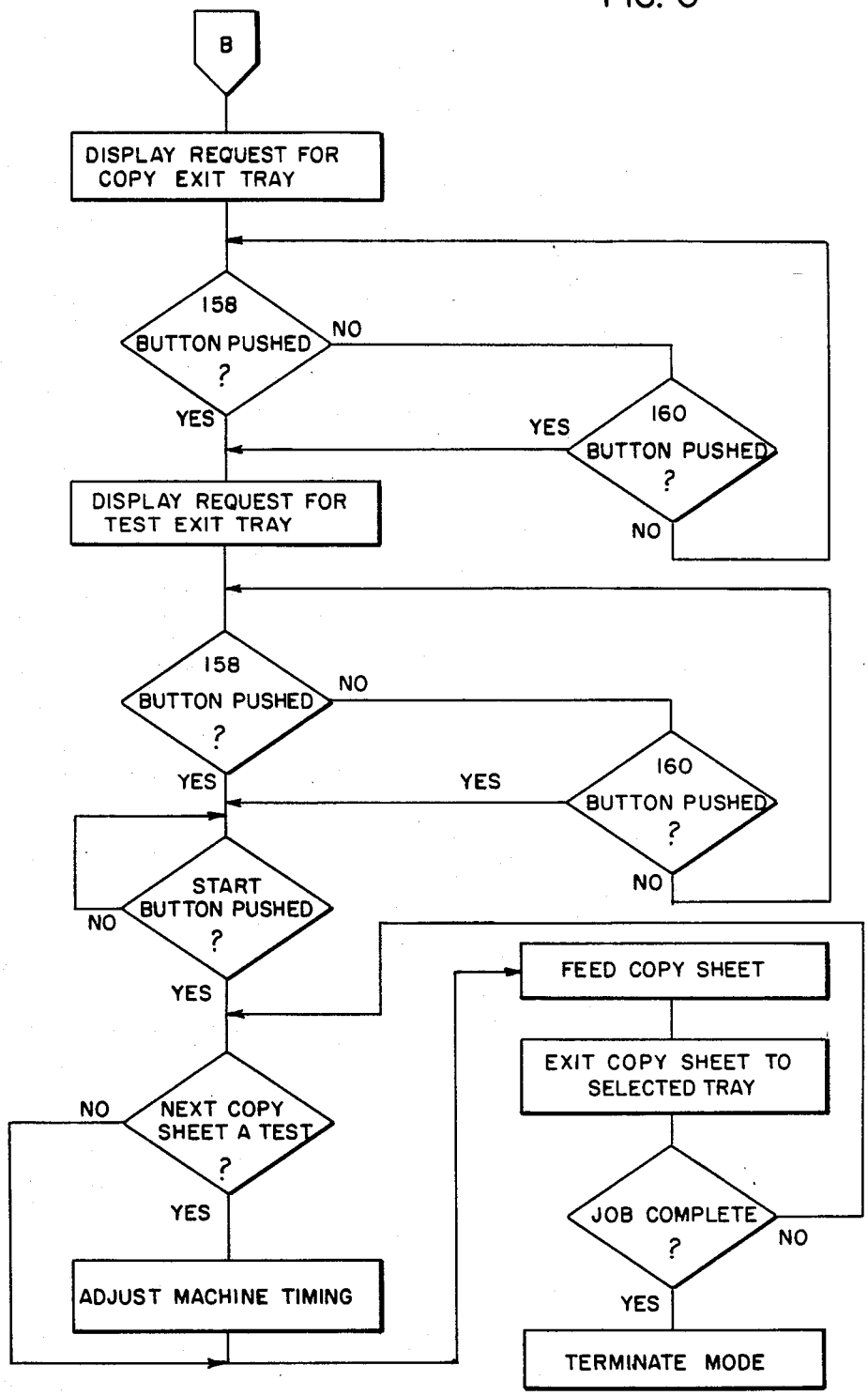

With reference to FIGS. 4 through 6, the operation of machine 10 will now be described in accordance with the present invention in which test patches are selectively printed on copy sheets. In FIG. 4, there is shown a flow chart for a patch set-up mode. To enter the Patch set-up mode, the operator must press 888* on panel 117, whereupon the operator will be prompted with an introductory message on display 162 "PATCH PRINTING MODE, PRESS * FOR SELECTIONS, OR STOP TO EDIT." The operator uses "*" button 134 to scroll through the various patch printing modes available. When the desired mode is displayed, a "select" button 149 is pushed to select that particular mode.

Thus, as shown in FIG. 4, the operator enters the patch mode by entering 888*. The operator is asked if patches are required on all copies. If so, select button 149 is pushed. Referring to FIG. 5, the operator may next select an exit tray and start copying. During the copy cycles, the machine timing is adjusted to produce copies with test patches thereon. The timing adjustments will be discussed hereinafter.

If the operator does not desire test patches on all copies, he or she pushes "*" button 134 (rather than "select" button 149) when asked if patches are required on all copies. The operator will next be asked for the exit tray for copies without patches, and for the exit tray for test copies with patches (see FIG. 6).

MACHINE TIMING

There are several ways to adjust machine timing so that the test patches, which are normally located in the image interframe region of belt 12. Some of those ways are:

1. Advance or delay the exposure of the original document and the test patches sufficiently to shift the images thereof on belt 12;
2. Advance or delay the feeding of copy sheets 76 by registration means 86;
3. Advance or delay the exposure of only the test patches to shift the image thereof in image areas 110, provision being made to inhibit discharging the belt by the original document in the area of the test patch image; and
4. Various combinations of the above.

TEST PATCHES IN MARGIN

Figure 7:
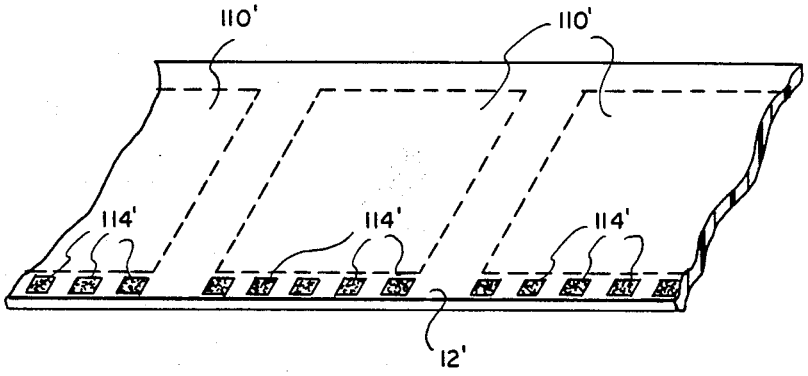
FIG. 7 is a view similar to FIG. 2 of another embodiment of the invention.
Figure 8:
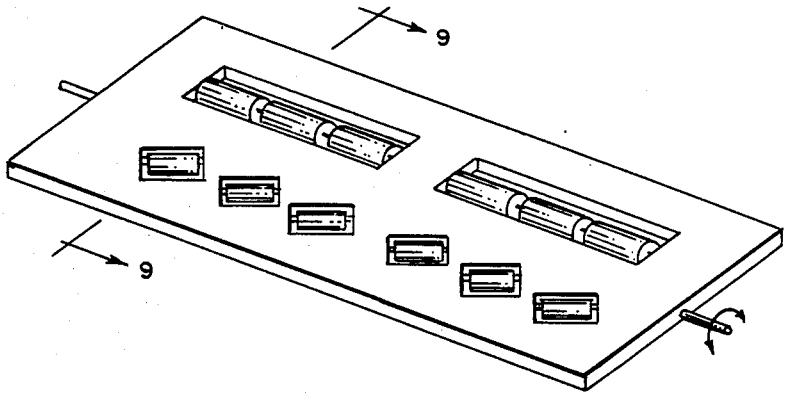
FIG. 8 is a perspective view of a portion of the machine of FIG. 1.

Whereas FIG. 2 depicts a photoconductive belt having test patches in the interframe region between image areas, FIG. 7 shows a similar photoconductive belt 12' having test patches 114' in the cross-track margin region laterally outside of image areas 110'. As such, adjusting machine timing as described hereinbefore would not affect a repositioning of the copy sheets relative to the test patches such that the copy sheets would align with the patches. Accordingly, I have schematically shown a mechanism 170 in FIGS. 8 and 9 for selectively shifting the copy sheets cross track when copies are to include test patches.

Figure 9:
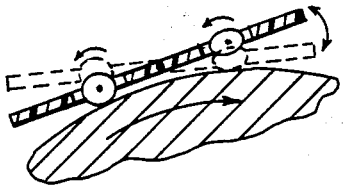
FIG. 9 is a sectional view taken above line 9–9 of FIG. 8.

Mechanism 170 is positioned in the feed path of copy sheets 76, and includes a plate 172 with a first set of idler rollers 174 aligned with the path of copy sheets 76 and a second set of idler rollers 176 set at an angle to the direction of incoming copy sheets. Plate 172 can be rocked about an axis 178 so that either rollers 174 or 176 contact a drive cylinder 180, as shown in FIG. 9. If rollers 174 are driven, copy sheets are moved along the feed path to transfer station 74 without deviation so as to align with image areas 110' of belt 12'. When copy sheets are to receive test particles as determined by LCU 62, plate 172 is rocked to its broken line position of FIG. 9 so that rollers 176 are driven. Now, advancing copy sheets are shifted laterally as they are fed to the transfer station. The copy sheets are shifted cross track relative to belt 12' so as to overlie the test patches. The logic flow diagram of FIGS. 4–6 are applicable also to the embodiment of FIGS. 7–9, except that each operation labeled "adjust machine timing" would be entitled instead "align copy sheets cross track."

This invention has been described in detail with particular reference to a preferred embodiment thereof, but it will be understood that variations and modifications can be effected within the spirit and scope of the invention.

I claim:

1. In an electrographic copy machine of the type having an image transfer member, means for producing document images in an image area of the image transfer member, and means for producing test patch images on the image transfer member, the improvement including apparatus for selectively controlling whether or not the test patch images are transferred from the image transfer member to the copy sheets, said apparatus comprising:

means for selectively aligning or not aligning the copy sheets and the test patches on the image transfer member; and means for effecting the transfer of images from the image transfer member to a copy sheet aligned with the images to be transferred, whereby the copy sheets receive or do not receive images of the test patches in accordance with the relative positions of the copy sheets and the test patches on the image transfer member.

2. The improvement as defined in claim 1 wherein said aligning means includes means for selectively positioning copy sheets relative to the image transfer member to selectively align or not align with the test patches.

3. The improvement as defined in claim 1 wherein:

the means for producing test patch images is effective for locating the test patch images in the interframe region between the document images; and said aligning means includes means for adjusting machine timing such that the copy sheet aligns with the test patches.

4. The improvement as defined in claim 3 wherein said timing adjusting means is effective to shift the position of the copy sheet on the image transfer member relative to the document and test patch images.

5. The improvement as defined in claim 3 wherein said timing adjusting means is effective to shift the position of the test patch image relative to the document image whereby they are superimposed.

6. The improvement as defined in claim 1 wherein:

the means for producing test patch images is effective for locating the test patch images in the cross-track region of the image transfer member laterally spaced from the document image; and said aligning means includes means for adjusting the cross track position of the copy sheet to selectively align the copy sheet with the test patches.

7. In an electrographic copy machine of the type having an image transfer member, means for producing images of a plurality of original documents in image areas of the image transfer member, and means for producing test patch images on the image transfer member; the improvement including apparatus for selectively transferring the test patch images from the image transfer member to the copy sheets, said apparatus comprising:

means for selectively aligning copy sheets and the test patches on the image transfer member;

means for effecting the transfer of images from the image transfer member to a copy sheet aligned with the images to be transferred, whereby the copy sheets receive or do not receive images of the test patches in accordance with the relative positions of the copy sheets and the test patches on the image transfer member; and control means for operating said machine in a noncollate mode such that multiple copies of each original document are produced before copying the succeeding document and for causing a copy sheet to receive images of the test patches after a predetermined number of copies have been made.

8. The improvement as defined in claim 7 further comprising;

at least two copy output trays; and means for directing copies with images of test patches to one of said trays and copies without images of test patches to the other of said trays.

9. In an electrographic copy machine of the type having an image transfer member, means for producing images of a set of original documents in image areas of the image transfer member, and means for producing test patch images on the image transfer member; the improvement including apparatus for selectively transferring the test patch images from the image transfer member to the copy sheets, said apparatus comprising:

means for selectively aligning copy sheets and the test patches on the image transfer member;

means for effecting the transfer of images from the image transfer member to a copy sheet aligned with the images to be transferred, whereby the copy sheets receive or do not receive images of the test patches in accordance with the relative positions of the copy sheets and the test patches on the image transfer member; and control means for operating said machine in a collate mode such that multiple copies of the original document set are produced and for causing all copy sheets of one set to receive images of the test patches after a predetermined number of sets have been copied.

10. The improvement as defined in claim 9 further comprising:

at least two copy output trays; and means for directing sets with images of test patches to one of said trays and sets without images of test patches to other of said trays.

* * * * *